US008387349B2

(12) United States Patent
Bellante

(10) Patent No.: US 8,387,349 B2
(45) Date of Patent: Mar. 5, 2013

(54) MACHINE FOR CARTONING PRODUCTS

(75) Inventor: Daniele Bellante, Garbagnate Monastero (IT)

(73) Assignee: CAMA1, S.p.A., Milan (IT)

( * ) Notice: Subject to any disclaimer, the term of this patent is extended or adjusted under 35 U.S.C. 154(b) by 0 days.

(21) Appl. No.: 13/042,027

(22) Filed: Mar. 7, 2011

(65) Prior Publication Data

US 2011/0283668 A1 Nov. 24, 2011

(30) Foreign Application Priority Data

May 21, 2010 (EP) ..... 10425169

(51) Int. Cl.
*B65B 43/26* (2006.01)

(52) U.S. Cl. ..... 53/564; 53/251; 53/563; 53/566

(58) Field of Classification Search ..... 53/558, 53/563, 564, 566, 235, 250, 251, 284.5
See application file for complete search history.

(56) References Cited

U.S. PATENT DOCUMENTS

| | | | | |
|---|---|---|---|---|
| 3,854,270 | A * | 12/1974 | Cloud et al. | 53/540 |
| 3,875,724 | A * | 4/1975 | Langen | 53/462 |
| 4,358,918 | A * | 11/1982 | Groom et al. | 53/74 |
| 4,566,836 | A * | 1/1986 | Berger et al. | 414/791.6 |
| 4,633,655 | A * | 1/1987 | Nigrelli, Sr. | 53/543 |
| 4,951,445 | A * | 8/1990 | Thibault | 53/167 |
| 5,105,600 | A * | 4/1992 | DePoint et al. | 53/468 |
| 5,727,365 | A * | 3/1998 | Lashyro et al. | 53/448 |
| 6,058,679 | A | 5/2000 | Ziegler et al. | |
| 7,322,171 | B2 * | 1/2008 | Bonnain et al. | 53/446 |
| 7,644,558 | B1 * | 1/2010 | Fallas | 53/251 |

FOREIGN PATENT DOCUMENTS

| | | |
|---|---|---|
| EP | 0695703 A1 | 2/1996 |
| EP | 0915012 A1 | 5/1999 |
| EP | 1050471 A2 | 11/2000 |

* cited by examiner

*Primary Examiner* — Thanh Truong
(74) *Attorney, Agent, or Firm* — Seed IP Law Group PLLC

(57) ABSTRACT

A machine for cartoning products incorporates a cardboard box forming section, at least one box conveyor, and one robotic loading section. The machine includes a section for closing boxes, for example by folding and gluing the respective flaps. The closing section is fed directly by the box conveyor. During the closing operation, a servo-train of the conveyor is operated with a forward motion synchronized with the work cycle of a closing device of the closing section.

12 Claims, 5 Drawing Sheets

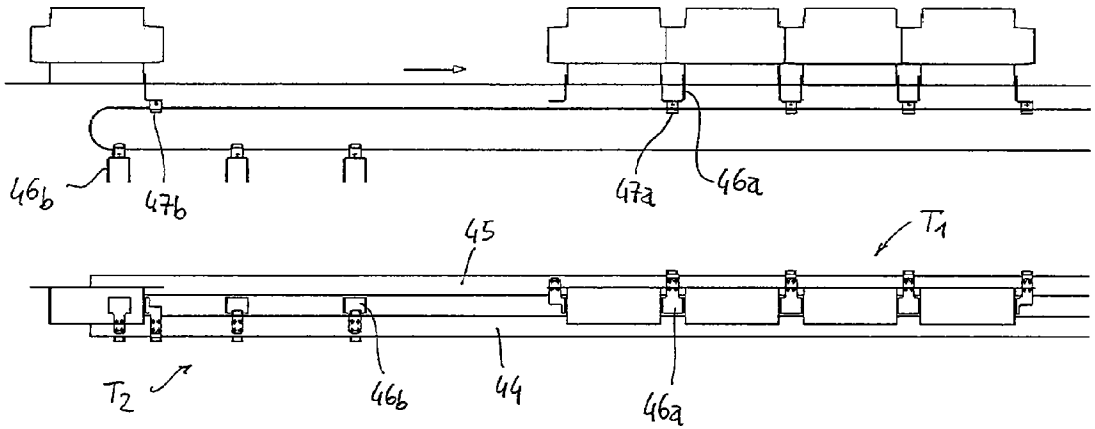
FIG. 5
FIG. 6
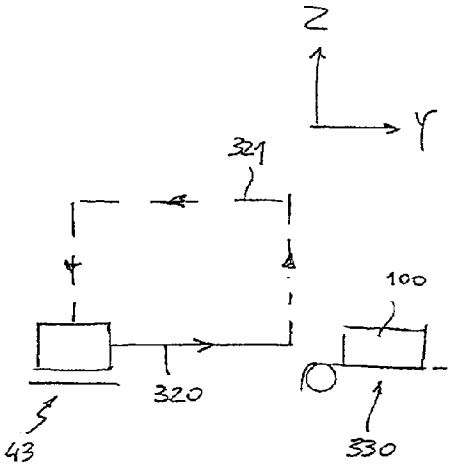
FIG. 8
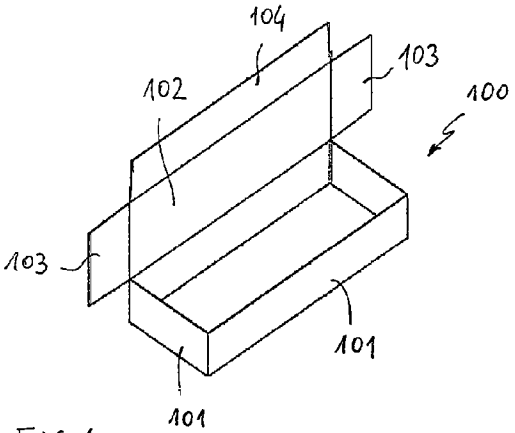
FIG. 4

MACHINE FOR CARTONING PRODUCTS

BACKGROUND

1. Technical Field

The present invention relates to the field of machines for cartoning products.

2. Description of the Related Art

The cartoning of products inside cardboard boxes substantially involves the following operations: forming boxes from cardboard blanks; receiving incoming products from one or more infeeds; loading products into the boxes according to a given grouping, closing of the boxes.

According to prior art, the packaging lines dedicated to performing these operations comprise: a box forming section; at least one loading robot; a closing section; and at least one linear translation system.

In the forming section, a device such as a male part cooperating with a die forms the cardboard boxes from flat blanks. The boxes are transferred from the forming section to said linear translation system, and are then loaded by said at least one robot.

More specifically, in intermittent lines or intermittent machines the translation system stops at a loading station, so that the box remains open and stationary during the loading phase, which comprises one or more work cycles of the above-mentioned robot. Said robot may for example be a two-axis robot equipped with a suitable pick-up device. In other lines or machines, loading may be performed by 4-axis robots capable of line-tracking the boxes; in this case the load is termed "in tracking". The loading follows a pre-determined grouping, corresponding to a certain number of units of products per box. The closing section operates by applying glue or by other equivalent means.

According to the prior art, the packaging lines that perform these operations are formed by several machines connected by conveyor belts. For example, a line comprises a carton forming machine, a robotized loading station and a closing machine that are separate from each other. The boxes are transferred from the loading station to the closing machine by an auxiliary conveyor belt which acts as the connection interface between the loading station and the closing machine.

This approach is known however to limit the maximum speed of the machine. In fact, the closing machine must maintain the same production speed of the sections upstream, that is to say that the closing machine must process the same number of boxes per minute that are respectively formed and loaded; to this purpose, it has been noted that the transfer of boxes from the loading station to a closing machine by an auxiliary conveyor belt is unable to reach and reliably maintain the high operating speeds that are more and more frequently required by the market. In other embodiments, robots are used to transfer the boxes to the closing devices and/or to perform the closing operations. The use of robots for operations such as closing the boxes, which are considered secondary operations compared to loading, involves an increase in costs particularly if the robot must operate at high speeds.

BRIEF SUMMARY

The purpose of the invention is to overcome the above described limitations of the prior art.

The invention provides a machine with an integrated closing machine, comprising a closing section that is fed directly by the box translation system. For example, in a machine equipped with a servo-train conveyor, said conveyor directly feeds the closing machine and equally assists the box-forming and loading operations.

The above purpose is reached with a machine for cartoning products that comprises: at least one product infeed; a cardboard boxes forming section; at least one translation system capable of transporting said boxes; at least one robot adapted to load products into said boxes; a box closing section; said translation system comprising a plurality of linear translation devices with independent movement, and a control system of said translation devices; said closing section comprising at least one mobile device operating with an intermittent work cycle on a box which positioned in a delivery station of said box translation system; one of said linear translation devices being operated by said control system with a feed motion synchronized with said at least one mobile closing device, to feed said closing section.

The above-mentioned translation system is a multiple system allowing at least two separate boxes or separate groups of boxes to advance with an independent movement. For example, the advance of a first box or a first group of boxes can be coordinated with the work cycle of the loading robot and, at the same time, the advance of a second box or a second group of boxes can be coordinated with the work cycle of said mobile closing device.

A multiple translation system that can be used for this purpose may be realized according to per se known technique. Two preferred embodiments, which are mentioned by way of non-limiting examples, respectively comprise a servo-train conveyor, or a translation system comprising a plurality of linear conveyors that are independent of each other.

A servo-train conveyor essentially comprises a plurality of box transportation devices such as for example so-called "flights", or equivalent, arranged in a plurality of trains; at least two trains move independently of each other, being connected to two respective belts with dedicated drive and control. The belts, in this embodiment, represent the individual devices of the machine's linear translation system. During operation, at least one train of boxes can advance in an intermittent way and synchronized with the closing devices, while the advance of at least one other train is synchronized with the loading robot. The conveyor control system is made according to the per se known technique in this field. A servo-train conveyor is described in a greater detail for example in EP-A-0695703.

In said embodiment of the invention, the servo-trains alternately assist the box-forming, product-loading and box-closing operations. One servo-train of said plurality of servo-trains is operated by said control system with an advance motion synchronized with the said at least one mobile closing device, when said servo-train is located in correspondence of the closing section of the machine.

In a second embodiment which is generally cheaper, the linear translation system is represented substantially by a plurality of linear runs, for example three linear runs which assist in taking boxes from the forming section, loading them and feeding them into the closing machine respectively.

Said at least one mobile device of the closing section is dedicated to the box closing operations, for example by gluing the respective flaps. Said mobile device, for this purpose, can cooperate with fixed devices of the closing section.

According to a particularly preferred embodiment, the closing section comprises a head that moves along two axes, in a vertical plane. Said two-axis closing head has an active working travel, starting from the delivery station of the box translation system which feeds the closing section, and a subsequent return travel. While effecting the working travel, said closing head imparts to a box a movement along a predefined path in the closing section; the closing section preferably comprises at least one shaped guide for closing one or more flaps of the box and optionally one or more glue-application units, located so as to act on a box along said path.

The vertical plane of movement of the closing head may, for example, be parallel or perpendicular to the direction of the box translation. In this latter case, the machine has an outfeed of the finished boxes which is angled at 90 degrees relative to a main direction of the box translation system, and a more compact machine with reduced length may be realized.

Said closing head is preferably equipped with its own mobile devices to close the flaps of a box. For example said mobile devices of the closing head are pneumatically operated. In a preferred embodiment said mobile head comprises a pivoted front clamp positioned so as to press a front flap of the lid of said box, when the mobile head is positioned on the box. Said pivoted clamp may be operated for example by a pneumatic actuator associated to the closing head.

In a more preferred embodiment the closing section comprises one shaped guide or more shaped guides positioned so as to cause the lid and/or flaps of a box transported by the box translation system to close, particularly in the section between said loading station and said delivery station.

It should be noted that the cardboard boxes can have various configurations; typically a machine of the type herein considered handles rectangular boxes with one or three flaps, and the closing devices such as shaped guides and gluing units will be provided accordingly.

According to another aspect of the invention, the machine is made with a modular frame, said frame comprising at least a first module which represents the load-bearing structure of the box forming section; a second module which represents the load-bearing structure of the loading section; and a third module which represents the load-bearing structure of the closing section.

The advantages of the invention are first related to the complete integration of the closing section with the box-forming and loading sections. It shall be noted that the invention achieves both structural and operational integration between the closing and forming/loading operations and related devices. Referring for example to a machine with a servo-train box conveyor, an advantage of the invention is that the same conveyor performs an intermittent advance of a train of boxes coordinated with the work cycle of the loading robot, and an intermittent advance of a train of boxes coordinated with the work cycle of the mobile closing device, such as for example the above described two-axis head. It shall also be noted that the invention eliminates the transfer of boxes between the loading station and a separate closing machine by means of auxiliary carriers or by handling with robots, and eliminates the related downtime and/or cost complications. The invention has the advantage that the same conveyor works in coordination with the work cycles of the loading section and of the closing section respectively, that is of the related devices. It can be appreciated that the invention allows the machine to operate at higher speeds, compared to the prior art.

In a machine according to the invention, the closing operation starts at the end of the linear translation system, for example at the aforesaid delivery station of the servo-train conveyor, and then rapidly proceeds under the movement of the closing device. The closing device may be specially designed and consequently much faster and cheaper than a robot charged of said operation.

For the same reasons, the machine according to the invention is flexible as regards so-called format change, for example a change in the dimensions of the boxes and/or the grouping of the products inside the boxes.

Another advantage lies in the more compact construction of the machine. These and other advantages of the invention will emerge from the following description of a preferred embodiment.

BRIEF DESCRIPTION OF THE SEVERAL VIEWS OF THE DRAWINGS

FIG. 4 is a view of an example of a box which can be handled by the machine of FIGS. 1-4.

FIGS. 5 and 6 are simplified views of a conveyor of the machine of FIG. 1.

FIG. 8 is a schematic representation of the work cycle of the mobile head of FIG. 7.

DETAILED DESCRIPTION

Figure 1:
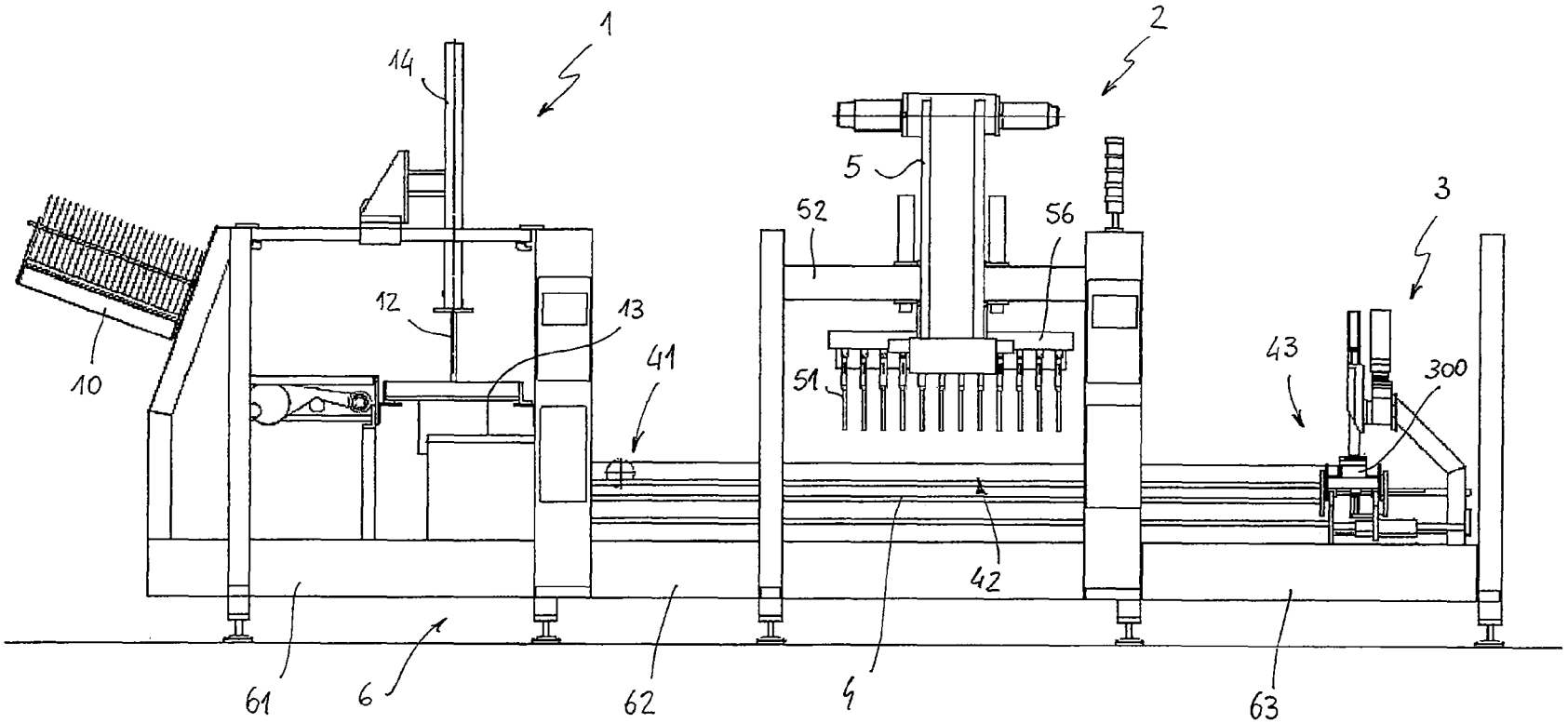
FIG. 1 is a side view of a machine according to one of the embodiments of the invention.

A machine for cartoning products is shown in FIG. 1 and comprises: a cardboard box forming section, indicated globally by 1; a loading section indicated by 2; a closing section indicated by 3; a linear translation system which in the figure is represented by a servo-train conveyor 4. The loading section 2 comprises a loading robot 5. The machine is supported, as a whole, by a frame 6.

Figure 2:
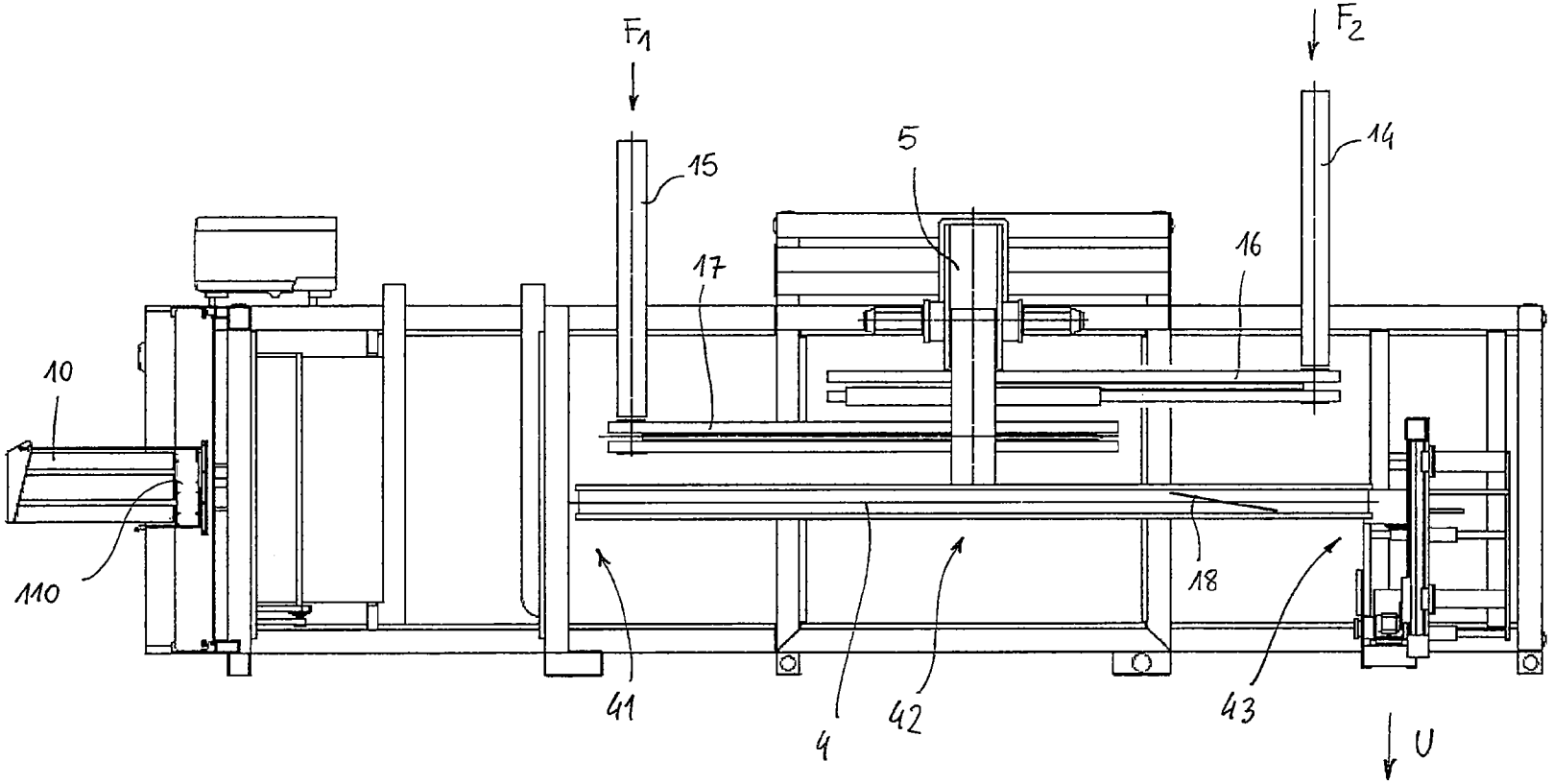
FIG. 2 is a top view of the machine of FIG. 1.
Figure 3:
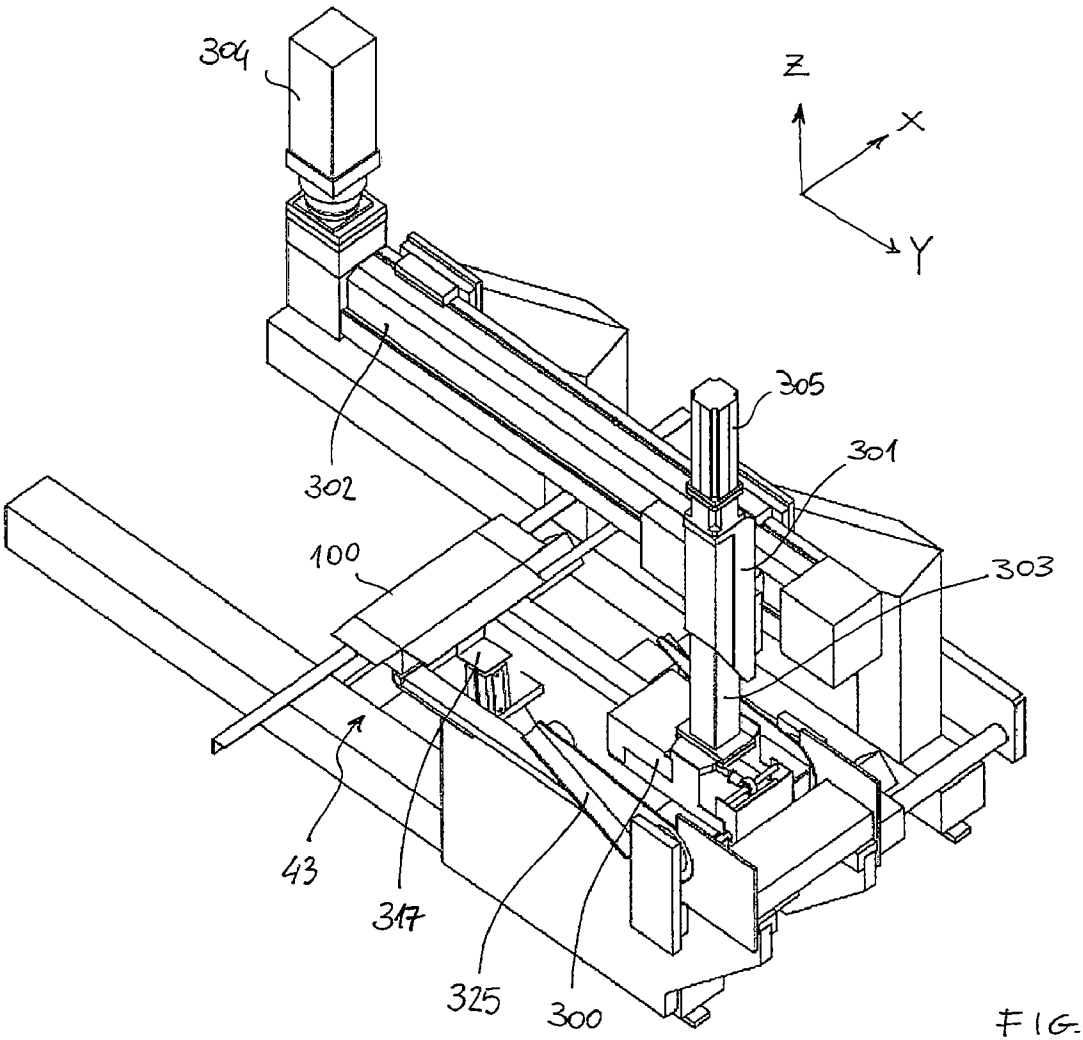
FIG. 3 is a perspective view of a detail of the closing section of the machine of FIG. 1.

The forming section 1 comprises a magazine 10 where flat cardboard blanks 110 are stacked (FIG. 2). A carton feeder takes the blanks 110 from the magazine 10 and feeds them into a forming die 13. A forming male part 12 moves in a vertical direction guided by a shaft 14 and acts in cooperation with said forming die 13. Under the action of said male part 12, a cardboard blank 110 positioned in the die 13 assumes the shape of a box, for example a rectangular box with a base, side walls and a lid.

The box is formed with one or more flaps, typically one or three flaps, provided for closing the box and possibly by applying glue. FIG. 4 is an example of a box 100 with three flaps, the box having a base, side walls 101 and a lid 102 with two side flaps 103 and a third front flap 104. The closing of the box 100 is substantially achieved by folding the lid 102 and gluing the abovementioned flaps 103 and 104 onto the respective side walls 101.

Turning back to FIG. 1, boxes 100 delivered by the forming section 1 are loaded onto the box conveyor 4 in a receiving station 41 of said conveyor 4. Lids 102 of the boxes are open to enable product loading.

The servo-train conveyor 4 comprises at least two trains of flights, or equivalent box-transporting means, linked to at least two respective motorized conveyor belts with an independent electronic control. Trains are therefore created on the conveyor 4, during the use, comprising a certain number of boxes, for example four boxes per train.

A control system of the conveyor 4 is capable of controlling the advance motion of said trains, synchronized with the forming section 1, loading section 2 and closing section 3. For example, a train of the conveyor 4 is controlled in the following way:

- the train of conveyor 4 is advanced step-by-step while in the receiving station 41, coordinated with the work cycle of the carton feeder and the male part 12, so that boxes delivered by the forming section 1 are loaded one by one on the conveyor 4;
- once fully loaded, the train is rapidly advanced to a loading station 42, where the robot 5 is operating; waiting and step-by-step advance in said station 42 is coordinated with the work cycle of said robot 5, depending on the grouping;
- the train is then rapidly advanced to the delivery station 43; subsequent step-by-step advance is synchronized with the work cycle of the closing unit(s) of the closing section 3;
- then, the train is quickly returned to the receiving station 41.

It shall be noted that the conveyor 4 reaches and directly feeds the closing section 3, through the delivery station 43 that delivers the boxes to the mobile closing unit(s) of said closing section 3.

The operation of the servo-train conveyor is illustrated in FIGS. 5 and 6. The conveyor 4 comprises two parallel adjacent conveyor belts 44 and 45; a plurality of groups of flights define respective trains to transport the boxes, in the figure the flights 46*a* define a train $T_1$ and the flights 46*b* define a train $T_2$; the distance between two of the flights 46*a* or 46*b* is equal to the width of the boxes 100.

Flights 46*a* are connected through fixing blocks 47*a* to the first belt 44, while flights 46*b* are connected through fixing blocks 47*b* to the belt 45. The supporting plane of the boxes 100 is raised in relation to the surface of the belts 44 and 45, so that the blocks 47*a*, 47*b* can be staggered as shown in the figure. It is understood that trains $T_1$ and $T_2$ can move independently, being connected respectively to the belt 44 and belt 45; for example the train $T_2$ can advance step-by-step while the train $T_1$ remains stationary, and so on.

Preferably, the conveyor 4 has more than two servo-trains, for example three trains so that each of machine sections 1, 2 and 3 may be assisted at any moment by a respective servo-train of said conveyor 4.

The mobile closing devices are made in accordance with specific requirements and in accordance with the shape and type of the cardboard boxes. In the example shown in the figures, the closing section 3 comprises a head 300 with two axis movement in a plane perpendicular to the direction of the box conveyor 4, that is with the boxes outfeeding at 90° as indicated by the arrow U in FIG. 2.

The loading and closing operations, and relative devices, are now described in further detail with reference to the machine illustrated in the figures.

The products are fed in two flows $F_1$ and $F_2$ respectively, arriving on two tracks 14 and 15 from which they pass to two respective product conveyors 16 and 17. The product conveyors 16 and 17 are preferably of the servo-train type and have trains of appropriate product-holding pockets, substantially similar to that described for the box conveyor 4. The products are represented, for example, by foodstuffs packed in pouches or the equivalent. The machine provides secondary packaging, grouping the products into boxes 100. This indication of use is given purely by way of example and is shall not be intended as limitative.

The robot 5 has at least one pick-up device capable of picking up the product from one of the conveyors 16 or 17, and positioning it in an open box 100 positioned in the loading station 42. During operation, the robot 5 picks up a collection of products alternately from the product conveyor 16 and from the product conveyor 17, and loads said collection of products into one or more boxes located in the loading station 42 on the box conveyor 4.

The figure shows a robot equipped with a pick-up device having parallel rods 51. Said robot 5 is supported by a frame 52 and comprises a fixed support, a first arm hinged at the said fixed support, and a second arm hinged at the end of the first arm. Rods 51 are carried by a head 56 that is hinged at the distal end of said second arm. Each of the rods 51 has an end effector connected to a vacuum system for lifting the products. During movement, the rods 51 shift from a pick-up position, on conveyor 16 or 17 respectively, to a position of releasing and loading the products into the boxes 100, keeping themselves substantially parallel to the vertical plane, thanks to the hinges between said arms and the head 56.

During the above-described loading operations, the lid 102 of the boxes is in a substantially vertical position, preferably open, forming an angle greater than 90 degrees with the horizontal plane, so as not to obstruct the descent of the rods 51.

In the next section of the conveyor 4 between the loading station 42 and the delivery station 43, one or more shaped guides can be fitted to fold parts or flaps of the boxes; for example a shaped guide which causes the progressive folding of the lid 102, bringing it into a position which is roughly aligned with the horizontal plane of the bottom of the box. Such a guide is represented by line 18 in FIG. 2. At least a first glue application unit can also be provided between said stations 42 and 43 of the conveyor 4; preferably a glue-application unit is arranged to deliver a quantity of hot-melt adhesive onto the underside of the front flap 104.

The operation of the closing section 3 is now described in greater detail.

In the delivery station 43, substantially at the end of the conveyor 4, a box 100 has the lid 102 folded substantially in the horizontal direction, due to the contact with the shaped guide between the stations 42 and 43, and has the respective flaps 103 and 104 still extended.

The head 300 has freedom of movement on two axes, namely transverse Y-axis and vertical Z-axis. The movement of the said head 300 is achieved by means of a carriage 301 that slides in direction Y along a guide 302 and carries a supporting beam 303 that slides in direction Z. The head 300 is fixed at the end of said beam 303. Movement is driven by two motors 304 and 305, with a per se known technique. The X-axis indicated in the figure corresponds to the longitudinal direction of the machine and to the direction of transport of the box conveyor 4.

Figure 7:
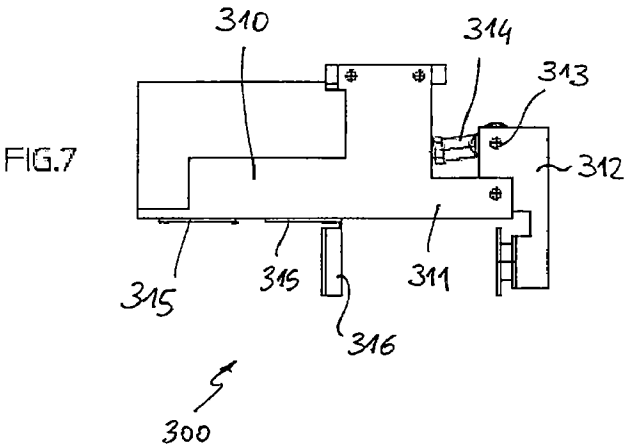
FIG. 7 is a detail of a preferred embodiment of the mobile head of the closing section of FIG. 4.

The head 300 preferably has a front pivoted clamp, to close and possibly glue the front flap 104 of the lid of a box 100. An example of an embodiment is shown in FIG. 7. The head 300 comprises two shaped plates 310 which represent the frame elements; the front parts 311 of the said plates carry a hinged clamp 312, which pivots about an axis shown as 313, and is operated by a pneumatic actuator 314 supported by the plates 310. The bottom part of the head carries two cross-pieces 315, arranged to press against the lid of a box 100, and a rear closing blade 316.

The closing section 3 comprises an additional mobile stop 317, which is located at the delivery station 43 of the box conveyor 4, and whose position is coordinated during use with the work cycle of the head 300.

The work cycle of the head 300 is represented schematically in FIG. 8. The head performs a working travel 320, along direction Y as defined above, starting from the delivery station 43; at the end of this travel 320 the closed boxes are delivered for example to a transporter 330 outside the machine. The head 300 then performs a return movement along travel 321, which brings the head back above the delivery station 43. While the head 300 performs said return travel 321, the box conveyor 4 advances by one step, positioning the next box 100 in the delivery station 43.

Figure 9:
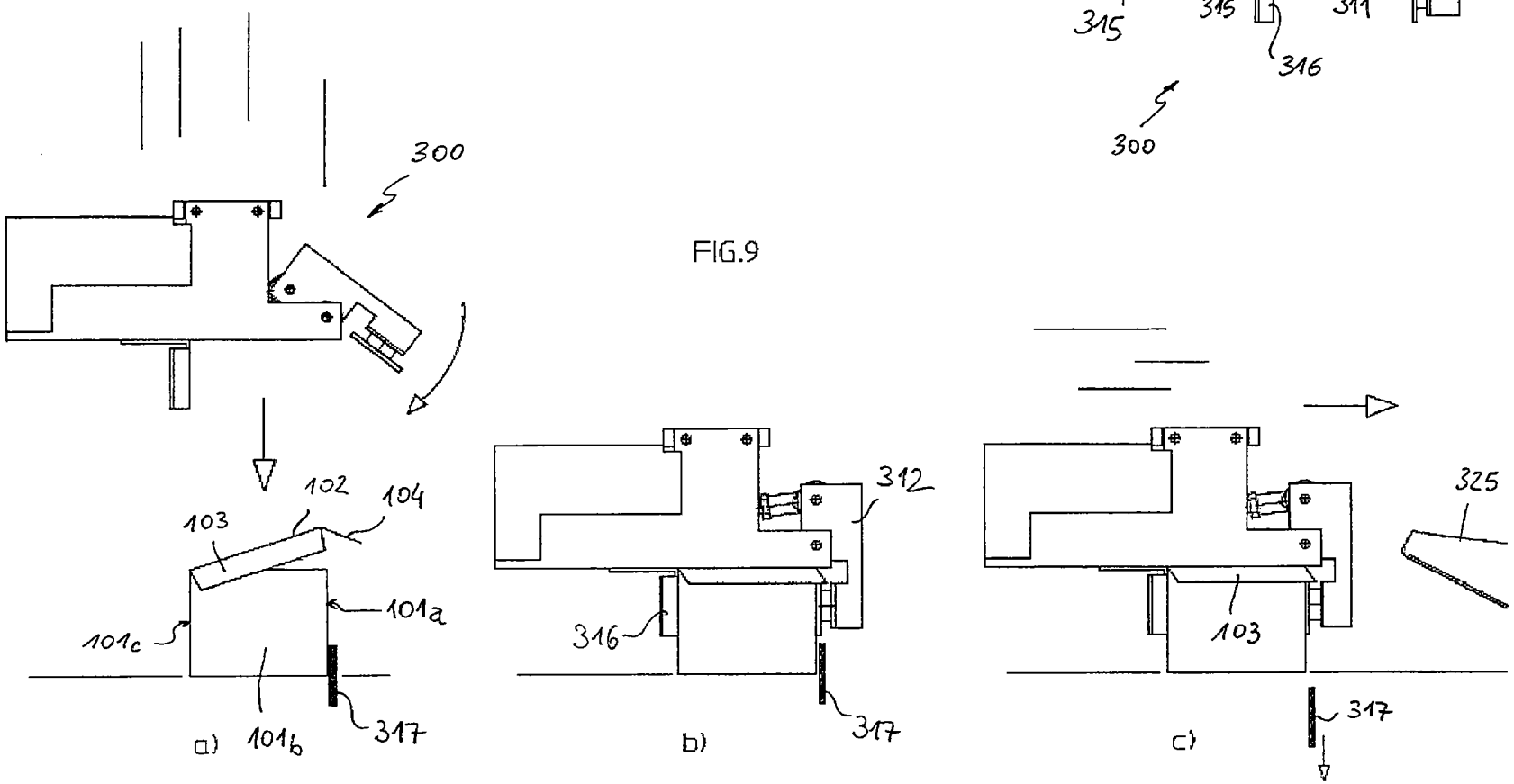
FIG. 9 shows schematically the box-closing operations performed by the closing section of FIG. 3 and relative mobile head.

The sequence of the head 300 acting on a box 100 is shown schematically in FIG. 9.

Position a) shows a box 100 in the delivery station 43. The lid 102 is lowered due to folding imparted by the guide 18, although due to the characteristics of the cardboard it tends to remain slightly raised, as shown in the figure. The front, side and back walls of the box 100 are indicated by numerals 101*a*, 101*b* and 101*c*, respectively. The head 300 descends onto the box from above, due to the effect of the rod 303 that slides relative to the carriage 301, and presses down the lid 102. Simultaneously, the front clamp 312 rotates around fulcrum 313, under action of the actuator 314. By doing this, said clamp 312 presses the flap 104 onto the front face 101*a* of the box 100 as in position b) of FIG. 9. If a quantity of glue has previously been applied to the flap 104, this operation causes the flap 104 to be glued onto the wall 101*a*.

It must be noted that the box is held in direction Y by the raised mobile stop 317, and by the blade 316 which is connected to the head 300 (position b) in FIG. 9). Immediately after the head 300 has been pressed onto the box, the mobile stop 317 is withdrawn and the head 300 begins a rapid forward motion performing the working travel 320 and dragging the box, as in position c) of FIG. 9.

During said travel 320, the flaps 103 are folded by a pair of shaped guides 325, fixed to the frame of the unit 3. During the advance of the box along the travel 320, the guides 325 impart a fold to the flaps 103; a glue-application unit is optionally provided on each side, immediately upstream of the leading edge of the respective guide 325. In this way, the flaps 103 are glued onto the respective walls 101*b* of the box during the working travel.

It can be noted that, in this embodiment, the outfeed of the finished boxes is at 90 degrees in relation to the direction of transportation along the machine. In equivalent embodiments of the invention, the box outfeed can be in line with the machine, i.e., along the X-axis according to the previously defined coordinates system.

Another example of application is represented by boxes with only one flap. In this case there is, for example, a cardboard blank which, after forming, generates a box with only one flap 104; in this case the machine need not have the equipment designed to fold and glue the side flaps.

The machine represented in the Figures has a substantially monoblock structure. As clearly indicated in FIG. 1 in particular, the frame 6 of the machine essentially comprises three modules 61, 62 and 63 for the forming unit 1, the loading section 2, with the robot 5, and the closing section 3 respectively. Each of said modules 61 to 63 substantially comprises a base frame and one or more vertical uprights. The elements of the base frame are hollow inside and, preferably, house the electrical and/or pneumatic connections between one module and the next.

Further details relating to the dynamic operation of the machine, in an embodiment given by way of example, now follow.

The flow of incoming products p (pieces/min) in the example shown is distributed between the two tracks and 14 and 15, but in other embodiments it may be on just one track. The number m of boxes per minute delivered by section 1 is linked to the said flow p by the grouping parameter, which is the number of products contained in a single box. For example, referring to the machine with two infeeds (FIG. 2) it may be that one train of boxes, positioned in the loading area 42, receives products from two respective trains of product-holding pockets of the conveyors 16 and 17.

The number m of boxes per minute delivered by the forming section 1 corresponds to the number of boxes processed by the closing section 3, in the example by the head 300. The working loop of the head 300 is therefore coordinated with the work cycle of the devices operating in the forming section 1, or in particular the forming male part 12. Consequently, a train on conveyor 4 advancing to the delivery station 43, may be connected to the same conveyor belt (such as belt 44 or 45 in FIG. 6) as a train that is positioned at the receiving station 41, since the step-by-step advance is the same.

The various embodiments described above can be combined to provide further embodiments. All of the U.S. patents, U.S. patent application publications, U.S. patent application, foreign patents, foreign patent application and non-patent publications referred to in this specification and/or listed in the Application Data Sheet are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A machine for cartoning products in cardboard boxes, comprising:

a product infeed;

a cardboard-box forming section;

a translation system adapted to transport said cardboard boxes;

a loading section comprising a robot adapted to load products into said boxes;

a box-closing section for closing said cardboard boxes;

said cardboard-box forming section, loading section, and box-closing section being arranged in a linear run;

said translation system comprising a plurality of linear translation devices which are extended from the forming section to the box-closing section, so that the translation system is able to deliver empty cardboard boxes from said cardboard box forming section to said loading section, and to feed the cardboard boxes loaded with the products from said loading section to said box-closing section;

said box-closing section comprising a mobile device operating with an intermittent work cycle, said mobile device being able to displace the cardboard boxes from the translation system when said cardboard boxes are positioned in a delivery station of said translation system;

said translation system comprising a control system of said plurality of linear translation devices, said linear translation devices being operable by the control system with independent movement from each other, and wherein said translation devices are operable with an advance motion coordinated with said intermittent work cycle of said mobile device of the box-closing section, when feeding the cardboard boxes loaded with the products to said box-closing section.

2. A machine according to claim 1 wherein said translation system comprises a servo-train system comprising a plurality of servo-trains with independent movement, one of said plurality of servo-trains being operated by said control system with an advance motion synchronized with said one mobile device, when said servo-train is in the box-closing section.

3. A machine according to claim 1 wherein said translation system comprising a plurality of linear run devices that are separate from each other.

4. A machine according to claim 1 wherein said mobile device comprises a closing head movable along two axes, in a vertical plane.

5. A machine according to claim 4 wherein said vertical plane is either parallel or perpendicular to a direction of transport of said translation system.

6. A machine according to claim 5 wherein said closing head has an active working travel substantially contained in said vertical plane, starting from said delivery station of the translation system, wherein said working travel imparts a predefined path in the box-closing section to a cardboard box, and said box-closing section comprising at least one shaped guide for closing one or more flaps of said cardboard box, located so as to act on a cardboard box along said predefined path.

7. A machine according to claim 1 wherein said mobile device comprising a front clamp pivoting about a fulcrum, by means of at least one actuator associated to said mobile device.

8. A machine according to claim 1 wherein said box-closing section comprising at least one fixed shaped guide positioned so as to cause the folding of a portion and/or of flaps of said cardboard boxes, said at least one guide being positioned between said loading station and said delivery station of the translation system.

9. A machine according to claim 1 wherein said box-closing section comprising a plurality of units for applying glue to one flap or several flaps of said cardboard boxes.

10. A machine according to claim 1, having a modular frame, said frame comprising at least a first module which represents the load-bearing structure of the forming section; a second module which represents the load-bearing structure of the loading section; a third module which represents the load-bearing structure of the closing section.

11. A machine according to claim 1, further comprising a translation device operable with an advance motion coordinated with said intermittent work cycle of said mobile device of the box-closing section and, at the same time, another translation device is operable with an advance motion coordinated with a work cycle of said robot, thus providing that the advance of a first cardboard box or first group of cardboard boxes is coordinated with the work cycle of said robot, and at the same time the advance of a second cardboard box or second group of cardboard boxes is coordinated with the work cycle of said mobile device.

12. A machine for cartoning products in cardboard boxes, comprising:

a product infeed;

a cardboard-box forming section;

a translation system adapted to transport said cardboard boxes;

a loading section comprising a robot adapted to load products into said boxes;

a box-closing section for closing said cardboard boxes;

said translation system comprising a plurality of linear translation devices which are extended from the forming section to the box-closing section, so that the translation system is able to deliver empty cardboard boxes from said cardboard box forming section to said loading section, and to feed the cardboard boxes loaded with the products from said loading section to said box-closing section;

said box-closing section comprising a mobile device operating with an intermittent work cycle, said mobile device being able to displace the cardboard boxes from the translation system when said cardboard boxes are positioned in a delivery station of said translation system; and said translation system comprising a control system of said plurality of linear translation devices, said linear translation devices being operable by the control system with independent movement from each other, and wherein said translation system comprises a servo-train system comprising a plurality of servo-trains with independent movement, one of said plurality of servo-trains being operated by said control system with an advance motion synchronized with said one mobile device, when said servo-train is in the box-closing section.

* * * * *